US007727387B2

(12) United States Patent
Goggin

(10) Patent No.: US 7,727,387 B2
(45) Date of Patent: Jun. 1, 2010

(54) SWIMMING POOL SKIMMER PUMP ASSEMBLY

(76) Inventor: Christopher M. Goggin, GoGGIN Research, Inc., 4510-D N. Chase Pkwy., NE., Wilmington, NC (US) 28405

( * ) Notice: Subject to any disclaimer, the term of this patent is extended or adjusted under 35 U.S.C. 154(b) by 214 days.

(21) Appl. No.: 11/523,906

(22) Filed: Sep. 19, 2006

(65) Prior Publication Data

US 2007/0163933 A1 Jul. 19, 2007

Related U.S. Application Data

(60) Provisional application No. 60/718,799, filed on Sep. 20, 2005.

(51) Int. Cl.
*E04H 4/16* (2006.01)

(52) U.S. Cl. ..... 210/167.12; 210/136; 210/416.2; 4/507

(58) Field of Classification Search ..... 210/167.1, 210/167.12, 167.19, 416.1, 416.2, 136; 4/507
See application file for complete search history.

(56) References Cited

U.S. PATENT DOCUMENTS 2,900,079 A * 8/1959 Pace ..... 210/167.12
3,169,920 A * 2/1965 Payne ..... 210/167.1
3,273,717 A * 9/1966 Canterbury ..... 210/167.26
3,306,448 A * 2/1967 Baker ..... 210/121
3,864,262 A * 2/1975 Lang et al. ..... 210/167.14
4,022,690 A * 5/1977 Smith ..... 210/167.1
4,430,214 A * 2/1984 Baker ..... 210/167.12
6,022,481 A * 2/2000 Blake ..... 210/776
6,572,765 B2 * 6/2003 Lincke ..... 210/167.12
6,979,401 B1 * 12/2005 Porter ..... 210/170.09

* cited by examiner

*Primary Examiner*—Fred Prince
(74) *Attorney, Agent, or Firm*—Michael E. Mauney

(57) ABSTRACT

A pool skimmer to operate independently of a pool filter pump. A pool skimmer has a bucket assembly similar to pool skimmers that use the filter pump to create a suction to draw and hold surface floating debris inside the pool skimmer where the debris can be removed from the bucket assembly and emptied. However, instead of using the pool filter pump, a sealed electrical pump assembly uses a rotatable magnetic assembly inside the sealed pump body. A magnetic impeller fits within the pump body and rotates in response to rotation of the magnetic assembly inside the sealed pump body. This creates a water flow forcing water out of the bucket assembly in contrast to using a filter pump to suck water through the bucket assembly as in conventional technology. Because each pool skimmer operates independently of others and of the filter pump, they may be located without regard to filter pump efficiencies. Moreover, the suction created is not enough to create a health hazard for users, especially small children.

12 Claims, 4 Drawing Sheets

SWIMMING POOL SKIMMER PUMP ASSEMBLY

RELATED APPLICATION

This application claims the benefit of a filing date of 20 Sep. 2005 of a Provisional Application Ser. No. 60/718,799.

FIELD OF THE INVENTION

This invention relates generally to swimming pool skimmers which are used to clean debris from the surface of a swimming pool or spa, and, more specifically, to a skimmer pump assembly specifically designed for the skimming application.

BACKGROUND OF THE INVENTION

The typical construction for a commercial or residential swimming pool uses a single pump. This pump causes circulation of water in the pool. It is a closed system in the sense that water is taken from the swimming pool thorough the skimmers by a suction created by a pump. The water pumped from the pool is passed through a filter or similar device for cleansing purposes. It may receive water treatment chemicals and then is returned to the pool from which the water was originally removed. Ordinarily, water is not added or lost during this process except small amounts that may be lost through leaks or evaporation. This system is an open hydraulic system in that the pressurized return water from the pump flows into an open body of water which is at atmospheric pressure. The filter pump is usually utilized to also provide suction to the skimmers. The skimmers are typically placed around the edge of a pool. Broadly speaking, a skimmer consists of a bucket-like device placed around the pool with an open side so that water from the pool can readily enter the skimmer bucket. There may be a check valve or weir door which will reduce wave action or other disturbances in the pool from taking floating material from the bucket once it has been pulled into the bucket by the suction created by the filter pump. At the bottom of the skimmer bucket is a pump suction inlet. Water is pulled through this suction inlet to the filter pump. Filters and pumps are normally sized at the pressure side of the pump and the pressure side performance always exceeds the suction pressure. The maximum suction pressure is limited by pump size, efficiency considerations, and atmospheric pressure.

This standard design results in a number of inefficiencies. First, there may be health department requirements regarding a minimum number of skimmers based on pool size. This may divide the return flow into the pump on the suction side into too many branches for efficient operation. Additionally, pools may be designed for aesthetic rather than pump efficiency purposes. Thus, landscaping and other esthetic design requirements determine routing of the return lines, which are not designed to equalize of maximize the efficiency of the return lines to the pump. If one or more of the skimmers are clogged by bad maintenance, or because of bad design, this may result in a higher suction at the remaining skimmers. This can result in poor cleaning of the pool or cause other health hazards like injury to pool users from high suction.

OBJECT OF THE INVENTION

It is an object of this invention to reduce pipe sizes needed for return flow to the filter. It is an object of this invention to provide equal and adequate flow at each skimmer. It is an object of this invention to make sure that the return flow pressure at each skimmer can be carefully controlled so it will not exceed a maximum pressure for safety reasons. It is the object of this invention for each skimmer pump to operate independently of the other skimmer pumps and to operate independently of the filter pump.

DETAILED DESCRIPTION OF THE DRAWINGS

Figure 1:
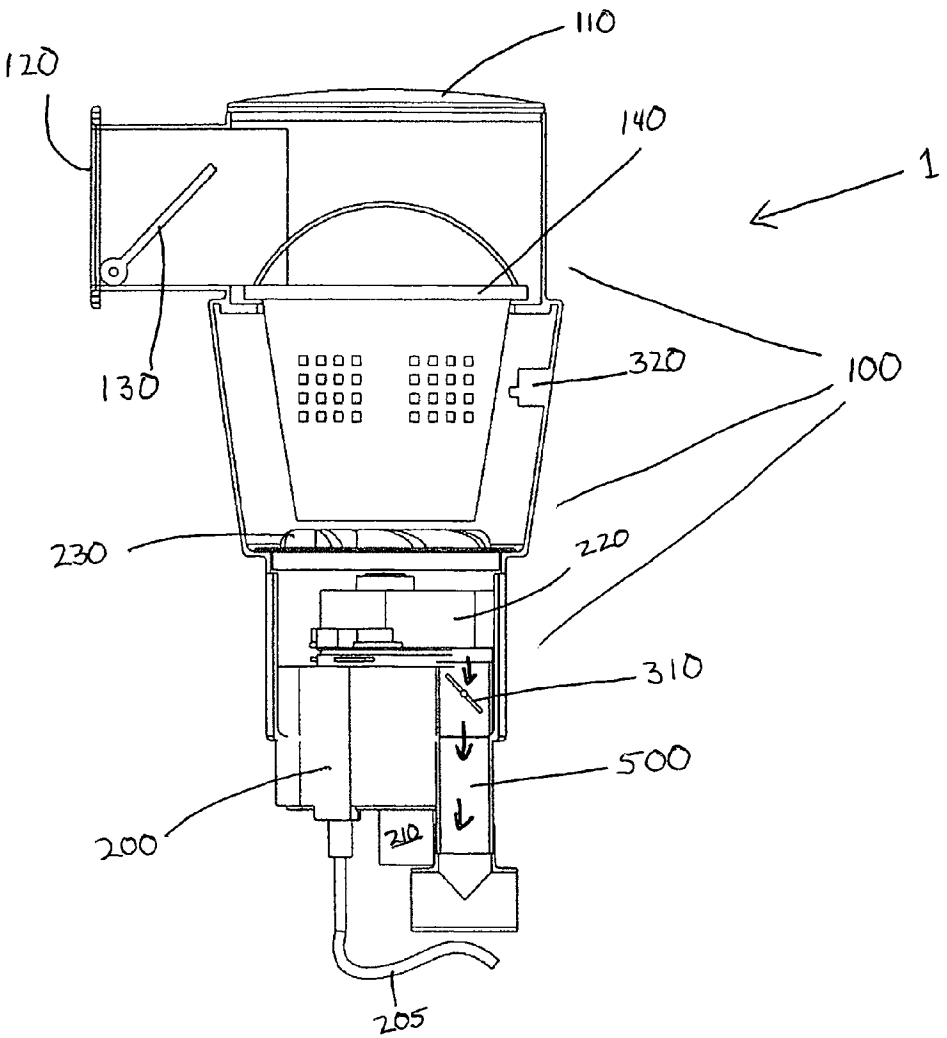
FIG. 1 shows the disassembled skimmer and impeller pump invention in partial cut-a-way.

FIG. 1 shows a skimmer and impeller pump assembly invention (1) in partial cut-a-way. The skimmer and impeller pump assembly (1) has a bucket body (100), which is shown in partial cut-a-way. A removable top cover (110) for the bucket body (100) covers an inflow opening (120) with a weir (130). Fitting within the bucket body (100) is a debris basket (140), which will ordinarily be dropped into the bucket body (100) when the top cover (110) is removed. At the bottom of the bucket body (100) is a sealed pump body (200). The sealed pump body (200) will be shielded so that the magnetic operation by electrical energy will not create a shock hazard for anyone servicing the skimmer and impeller pump assembly (1) nor for anyone using the pool. It will have to meet approved safety standards of the Underwriters Laboratory® as well as other industry standards for electrical devices used in conjunction with, or submerged within, water. The magnetic impeller (210) (seen in FIG. 2) slides into the pump body (200). Magnets rotate within the sealed pump body (200) to rotate the magnetic impeller (210) creating a pump action. The magnetic impeller (210) is covered by the pump cover (220). At the top of the pump cover (220) is the swirl safety cap (230). The swirl safety cap (230) is mounted above the pump cover (220). It serves a dual purpose. First it tends to force the water flow counterclockwise which increases flow into the pump cover (220) which increases the pumping efficiency of the magnetic impeller (210) and helps result in an even distribution of debris in the debris basket (140). The swirl safety cap (230) also serves to help protect a child from reaching into the pump. The safety swirl cap (230) has a child lock feature so that it must be pressed and turned into place in order to either remove it or to attach it, which works much like a child proof pill bottle cap. This prevents a child from reaching below the level of the safety swirl cap (230). The sealed pump body (200) has a power supply (210) which provides 12 volts DC current with 120 volt power cord (205). In order to provide a fail safe mechanism for the pump in the event the water supply falls too low, there is an optical water sensor (320) which operates a servo valve (310). The servo valve (310) closes if water drops below a predetermined level as determined by the optical sensor (320). Moreover, because the sealed pump body (210) operates by magnetic force, it does not turn the magnetic impeller (210) with enough torque to be dangerous even in the event a user was successful in removing the safety swirl cap (230), the pump cover (220), and placing his fingers into the magnetic impeller (210). Water leaves the pump cover in the direction shown by the arrows in FIG. 1 passing by the servo valve (310) and entering the water pipe (500). The functioning of the water pipe is shown in more detail in FIG. 4.

Figure 2:
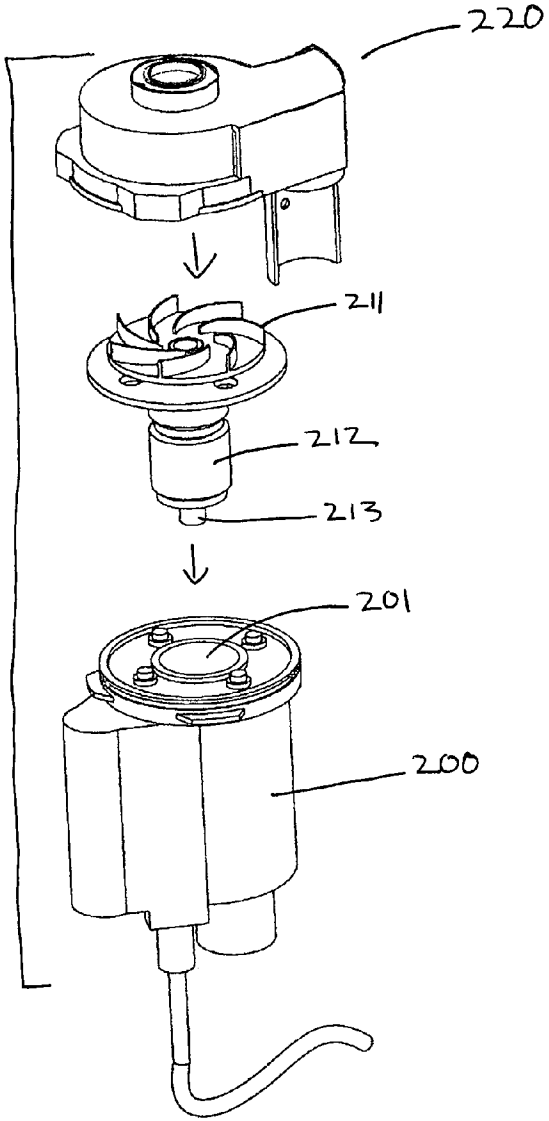
FIG. 2 shows an exploded view of the pump assembly.
Figure 3:
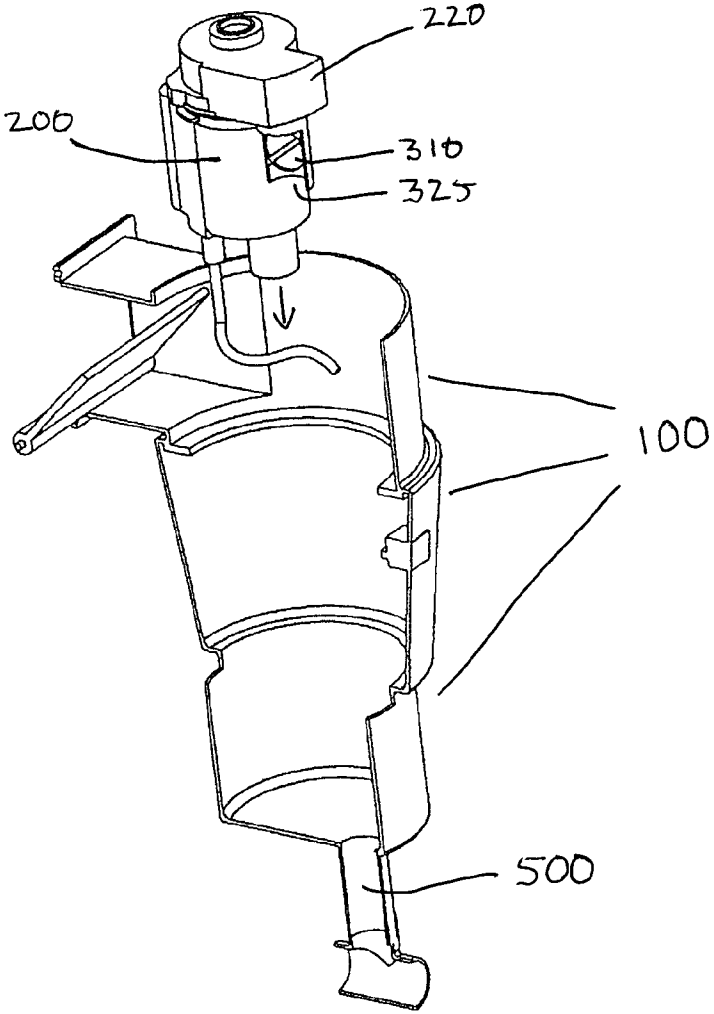
FIG. 3 shows the pump assembly pump body positioned for mounting in basket body.

FIG. 2 shows an exploded of the magnetic impeller (210), the pump body (200) and the pump cover (220). The magnetic impeller (210) consists of the impeller vanes (211), a shaft body (212), and a shaft mount (213). The magnetic impeller (210) simply drops into an opening (201) in the sealed pump body (200) as shown by the arrow in FIG. 2. The magnetic impeller (210) is mounted within the sealed pump body (200) using the opening (201) in the sealed pump body (200) for mounting of the shaft mount (213) and shaft body (212). Once the magnetic impeller (210) is mounted within the sealed pump body (200), assembly may continue, as is shown in FIG. 3. The sealed pump body (200) has no exposed moving parts as it rotates the magnetic impeller (210) by magnetic force. Because the pump body (200) is sealed, there is less danger of injury due to moving parts or to electrical shock.

FIG. 3 shows an assembled pump body (200) with magnetic impeller (210) and pump cover (220) ready to be dropped into place in the direction shown by the arrow into the bucket body (100) shown in cut-a-way. The servo valve (310) is shown by partial cut-a-way. The pump water outlet (325) fits into the water outlet pipe (500) also shown in partial cut-a-way. Water is pumped from the sealed pump body (200) through the top cover (220) through the servo valve (310) and through the pump water outlet (325) into the water outlet pipe (500) for eventual return to the pool.

Figure 4:
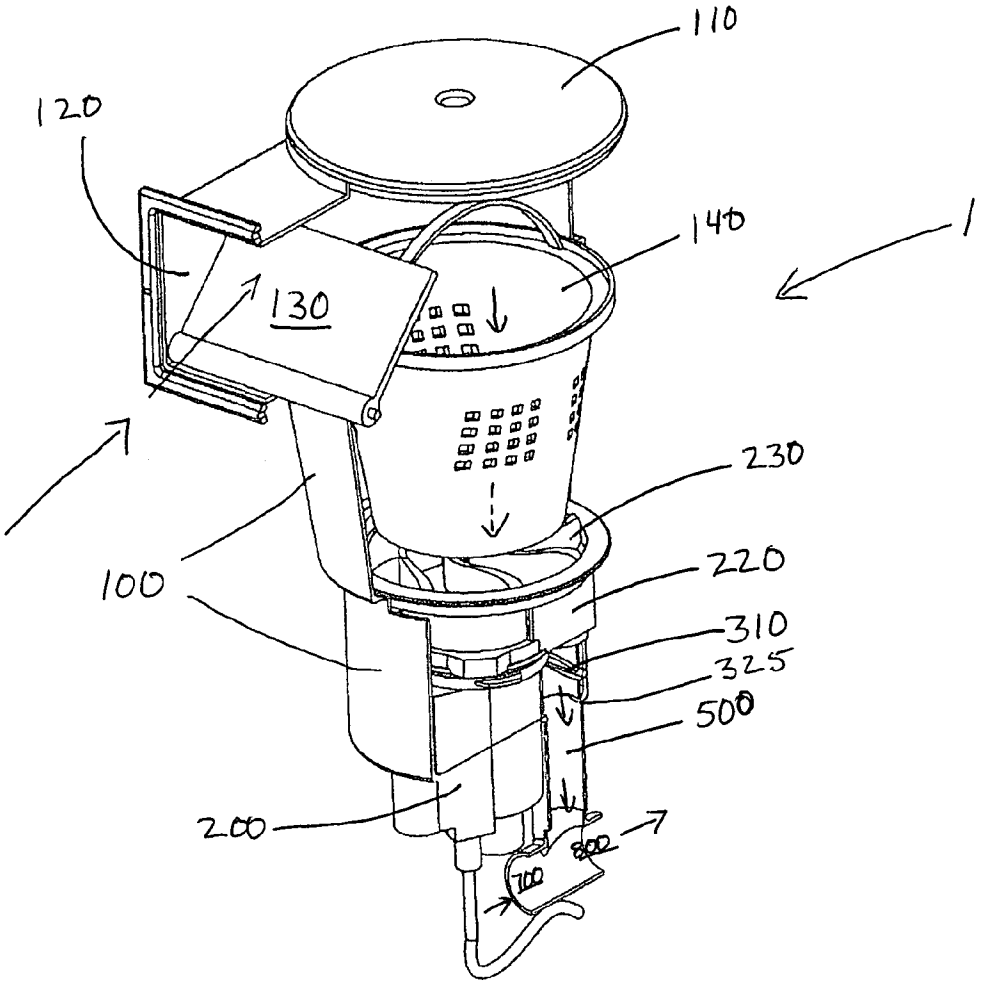
FIG. 4 shows water flow through the pool skimmer invention.

FIG. 4 shows the skimmer and impeller pump assembly invention (1) cut-a-way so as to better visualize the water flow. Water flows into the inflow opening (120) past the weir (130) and is pulled by the action of the sealed pump body (200) and the impeller (210) downward through the debris basket (140), across the swirl safety cap (230) into the top cover of the pump (220). The water is propelled by the rotation of the impeller (210) out the pump water outlet (325) through the servo valve (310) which is controlled by the action of the sensor (320) and into the water pipe (500). In the event the servo valve (310) is closed, bypass water (700) can enter the water pipe (500) in the direction shown by the arrow. Ordinarily, dirty return water (800) is pumped through the skimmer and impeller pump assembly (1) in the direction shown by the arrow where it returns to the pump room for filtering and pumping back into the pool.

Here, each skimmer and impeller pump assembly (1) operates independently of the other skimmers. Each one relies on the pump body (200) and magnetic impeller (210) to produce sufficient suction to completely skim the pool of unwanted floating debris but not enough to create a suction hazard. Because the skimmer and pump assembly (1) operate independently of each other and of the filter pump (not shown), the suction pressure within the skimmer and impeller assembly (1) remains constant at a controlled level. The swirl safety cap (230), debris bucket (140), and top cover (110) should prevent any potential injury to someone from the rotating magnetic impeller (210). However, even should someone put his or her hand into an open skimmer and impeller pump assembly (1), the magnetic impeller (210) does not rotate with enough torque that it would cause any more than bruising to a person who was foolish enough or inattentive enough to actually stick their finger into the magnetic impeller (210) as it was being rotated by the sealed pump body (200). Because each skimmer and pump assembly (1) operate independently of each other, the operation of one is not affected by the operation of another. They will all operate to continuously and appropriately skim the surface of the pool. Should one or more quit operating, it will not increase the suction created by the operation of the magnetic impeller (210) using the sealed pump body (200) in the other remaining operating skimmer and pump assembly (1). There is no danger of a catastrophic suction injury to a small child, who may inadvertently be in proximity to the skimmer and impeller pump assembly (1). The water flow return to the filter pump of the pool now is downstream from each skimmer and impeller pump assembly (1). Hence, the water flow is a positive pressure flow and does not require any particular level of suction from the filter pump to operate. If one or more of the skimmer and impeller pump assemblies (1) fail to operate, it will not affect the operation of the filter pump, nor will it increase or decrease the suction that the filter pump exerts on the returning water downstream from the skimmer and impeller pump assembly (1). These make it much easier to design pools to allow skimmers to be placed at unusual or odd points. The routing of the return pipes from the skimmer and impeller pump assemblies (1) to the filter pump does not create inefficiencies in the skimming of debris from the water. It reduces pipe size as needed for return flow to the filter pump. It reduces the risk of injury to the users of a pool by excess suction operating at the skimmer and reduces the reduce of injury to someone servicing the skimmer and impeller pump assembly (1).

I claim:

1. A pool skimmer device to operate independently of but connected with a pool filter and pump assembly comprising:

(a) a bucket assembly with at a first end of the bucket assembly a top cover;

(b) an intake port in said bucket assembly;

(c) at a second end of said bucket assembly opposite from said top cover, an electrically powered means for a magnetically operated pump;

(d) an outlet port for water pumped from inside of said bucket assembly to outside of said bucket assembly by said means for a magnetically operated pump body said outlet part operatively connected to said pool filter and pump assembly;

(e) a pump cover to fit on top of said magnetically operated pump;

(f) a swirl cap to fit above said pump cover to direct water flow in a predetermined direction whereby said means for a magnetically operated pump pumps water from the top of said bucket assembly through the outlet port in said bottom of pump assembly to result in a circulation of water into said bucket assembly thereby collecting debris floating on the surface of a pool.

2. A pool skimmer device to operate independently of a pool filter pump of claim 1 wherein said swirl cap further comprises safety means for mounting said swirl cap to fit above said pump cover wherein said swirl cap is not easily removed from said pump cover by a small child.

3. A pool skimmer device to operate independently of a pool filter pump of claim 2 further comprising a water sensor operating a servo valve to close said servo valve to prevent water from leaving said pool skimmer device when said water level reached a predetermined level.

4. A pool skimmer system to safely skim debris and unwanted materials from the surface of a swimming pool that operates independently of but connected with a pool filter pump comprising (a) at least two pump skimmers;

(b) each of said pump skimmers further comprising i) a bucket assembly with a first end of the bucket assembly a top cover;

ii) an intake part in said bucket assembly;

iii) at a second end of said bucket assembly, a magnetic water pump;

iv) means for limiting suction from said magnetic pump to a predetermined level;

v) an outlet part for water pumped from said bucket assembly by said magnetic water pump;

(c) pipe means to transport water from said outlet port on said at least two pump skimmers to a pool filter pump;

whereby a predetermined suction is maintained at each pool skimmer and water is skimmed and sent to a pool filter pump regardless of suction from a pool filter pump.

5. A pool skimmer system to safely skim debris and unwanted materials from the surface of a swimming pool that operates independently of and in connection with a pool filter pump of claim 4 wherein said predetermined level of suction is no more than a suction level established by regulatory standards.

6. A pool skimmer system to safely skim debris and unwanted materials from the surface of a swimming pool that operates independently of and in connection with a pool filter pump of claim 5 wherein said magnetic impeller and said sealed pump assembly further comprises a pump cover, said pump cover to fit on top of said magnetic water pump.

7. A pool skimmer system to safely skim debris and unwanted materials from the surface of a swimming pool that operates independently of and in connection with a pool filter pump of claim 6 further comprising a swirl cap to fit above said pump cover to direct said water flow in a counterclockwise direction into said pump cover to increase the efficiency of said pool skimmer.

8. A pool skimmer system to safely skim debris and unwanted materials from the surface of a swimming pool that operates independently of and in connection with a pool filter pump of claim 7 wherein said swirl cap further comprises safety means for mounting said swirl cap to fit above said pump cover wherein said swirl cap is not easily removed from said pump cover by a small child.

9. A pool skimmer system to safely skim debris and unwanted materials from the surface of a swimming pool that operates independently of and in connection with a pool filter pump of claim 8 wherein said magnet water pump further comprises a sealed pump body having a rotatable magnetic assembly inside of said sealed pump body and a magnetic impeller to fit within said sealed pump body to rotate in response to rotation of said magnetic assembly inside of said sealed pump body.

10. A pool skimmer system to safely skim debris and unwanted materials from the surface of a swimming pool that operates independently of and in connection with a pool filter pump of claim 9 further comprising in said intake port in said bucket assembly, a check valve device to allow debris to enter said bucket assembly in the direction of water flow but not to leave said bucket assembly.

11. A pool skimmer system to safely skim debris and unwanted materials from the surface of a swimming pool that operates independently of and in connection with a pool filter pump of claim 10 further comprising a debris basket of a particular size and shape to fit within said bucket assembly whereby said debris basket may be removed from said bucket assembly capturing any debris accumulating inside said pump assembly so that said debris basket may be used to remove debris from said pump assembly, hence from the surface of said pool.

12. A pool skimmer system to safely skim debris and unwanted materials from the surface of a swimming pool that operates independently of and in connection with a pool filter pump of claim 11 further comprising a water sensor operating a servo valve to close said servo valve to prevent water from leaving said pool skimmer device when said water level reaches a predetermined low level.

* * * * *